US011473892B2

(12) United States Patent
Santos et al.

(10) Patent No.: US 11,473,892 B2
(45) Date of Patent: Oct. 18, 2022

(54) VEHICLE FOR DEPOSITION OF EXPLOSIVES IN BLAST HOLES AND METHOD OF USE

(71) Applicant: VALE S.A., Rio de Janeiro (BR)

(72) Inventors: Reginaldo de Andrade Santos, Barão de Cocais (BR); Emerson Sena Balbino, Itabira (BR); André Luiz da Costa Vieira, Belo Horizonte (BR); Marcelo Ribeiro Carlos, Belo Horizonte (BR); Lucas Sales Van Melis, Santa Bárbara (BR); Adriano Nogueira de Assis, Carandaí (BR)

(73) Assignee: VALE S.A., Rio de Janeiro (BR)

( * ) Notice: Subject to any disclaimer, the term of this patent is extended or adjusted under 35 U.S.C. 154(b) by 1403 days.

(21) Appl. No.: 15/784,838

(22) Filed: Oct. 16, 2017

(65) Prior Publication Data

US 2018/0106584 A1 Apr. 19, 2018

(30) Foreign Application Priority Data

Oct. 17, 2016 (BR) ..... 102016024215-0

(51) Int. Cl.

| | |
|---|---|
| ***F42D 1/10*** | (2006.01) |
| ***F42D 3/04*** | (2006.01) |
| *E21C 37/00* | (2006.01) |
| *F42D 1/04* | (2006.01) |

(52) U.S. Cl.

CPC ..... *F42D 1/10* (2013.01); *F42D 3/04* (2013.01); *E21C 37/00* (2013.01); *F42D 1/04* (2013.01)

(58) Field of Classification Search

CPC ..... F42D 1/00; F42D 1/04; F42D 1/08; F42D 1/10; F42D 3/04

USPC ..... 102/301, 311, 312, 313; 86/50

See application file for complete search history.

(56) References Cited

U.S. PATENT DOCUMENTS

| | | | | |
|---|---|---|---|---|
| 6,272,405 | B1 | 8/2001 | Kubota | |
| 6,996,462 | B2 | 2/2006 | Heilmann et al. | |
| 8,261,664 | B2 * | 9/2012 | Von Lengeling | F42D 1/10 102/311 |
| 8,899,350 | B2 | 12/2014 | Nadeau | |
| 8,950,330 | B2 | 2/2015 | Waldock | |
| 9,207,055 | B2 * | 12/2015 | Halander | F42D 3/04 |
| 9,415,360 | B2 * | 8/2016 | Xue | B60P 3/24 |
| 10,570,736 | B2 * | 2/2020 | Wang | F42D 1/22 |

FOREIGN PATENT DOCUMENTS

| | | | | |
|---|---|---|---|---|
| CN | 105300206 A | * | 2/2016 | F42D 1/08 |
| CN | 205262311 U | * | 5/2016 | F42D 1/10 |
| DE | 10 2009 010 006 A1 | | 10/2009 | |
| WO | WO 2010/144952 A1 | | 12/2010 | |
| WO | WO 2014/063188 A1 | | 5/2014 | |
| WO | WO-2015140462 A1 | * | 9/2015 | C06B 23/004 |

* cited by examiner

*Primary Examiner* — James S Bergin

(74) *Attorney, Agent, or Firm* — ArentFox Schiff LLP

(57) ABSTRACT

Described is a vehicle configured for the deposition of explosives in holes of open-pit exploration mines, wherein the vehicle is able to perform all seven steps carried out in the manual explosive deposition process, automatically, completely free of human intervention. Also described is a method of use of the aforementioned vehicle.

17 Claims, 9 Drawing Sheets

VEHICLE FOR DEPOSITION OF EXPLOSIVES IN BLAST HOLES AND METHOD OF USE

CROSS-REFERENCE TO RELATED APPLICATION

This application claims the benefit of priority to Brazilian Patent Application No. 102016024215-0, filed Oct. 17, 2016, the disclosure of which is hereby incorporated by reference in its entirety.

INVENTION FIELD

The present invention includes an autonomous explosive truck configured to aid in the process of blasting of mining benches.

INVENTION BACKGROUNDS

Rock blasting is a key stage in mine development, and has the function of loosening, fragmenting and making ore available for subsequent phases of material transport and processing.

The rock blasting plan, which defines the planning of the blasting, varies according to the ore lithology to be worked, the geomechanical properties of the rock embankment, and the local geographic conditions. The same also takes into account the climatic conditions and the presence or absence of water in the blasting benches. A poorly drawn rock blasting plan can lead to the ore breaking, environmental impacts, or compromise the level of safety of the blasting operation.

After completion of the rock blasting plan, the holes are made in the top surface of the bench. Usually, these holes are made by using drill machines, such as the one shown in U.S. Pat. No. 8,899,350 (Caterpillar Inc.).

After making the holes, explosives are placed inside them. Then, the rest of the hole is filled with earth in order to enclose the explosive charge (an operation also known as "buffering").

Currently, the most common is that the deposition of explosives is performed manually, comprising the following steps:

Step 1—preparation and transport of explosive materials to blasting area. The operators begin the analysis of the hole network by measuring the hole depth with a tape, and also analyze the presence of water in the hole by checking the sound emanating from it when the tape touches the bottom of the drilling.

Step 2—discharge of the explosive bags from the truck.

Step 3—deposit a first portion of explosive into the hole until it fills approximately 8% of its depth (approximately 1 meter in height).

Step 4—assembly of the detonator, which consists of unwinding the shock tube and securing the end of the shock tube containing the fuse (the metal tip of that object) into an element called a booster.

Step 5—deposit the set assembled in step 4 in the hole, leaving the other end of the shock tube out of the hole.

Step 6—deposit of the rest of the explosive into the hole, according to the planned height for the charge.

Step 7—buffering, which consists of completing the hole filling with the amount of earth that is around the hole.

The manual process of deposition of explosives has numerous failures, such as: subjection of workers to critical conditions of ergonomics; exposure of workers to a high risk of explosive manipulation; as well as, failures in execution from the human factor.

There are some techniques in the State of the Art which reveal semi-automated vehicles, configured for deposition of explosives in bench holes. However, none of these techniques is completely independent of the human factor, nor does it show acceptable levels of efficiency, quality and predictability of results.

For example, U.S. Pat. No. 8,950,330 shows a truck configured to load detonation holes with explosives. The truck comprises a tank, a mixing shovel, a feed tube and a control system. The tank is configured to store the explosive material during transportation and loading of the detonation hole, and the feed tube allows the positioning of its free end over the detonation hole, allowing the explosive material to be deposited within the detonation hole after it passes through the feed pipe.

The truck shown in U.S. Pat. No. 8,950,330 contains a control for handling the feed tube, arranged inside the vehicle cabin. However, in spite of comprising a feed tube control device, the mentioned device is driven by human interface, and not automatically. Although the system shown in U.S. Pat. No. 8,950,330 allows some distance between the operator and the explosive charge, such distance is absolutely ineffective in an explosion situation, for example. Even if the operator has control of everything while inside the truck cabin, there is a danger of accidental explosions of the explosive charge.

Document WO2010144952 shows an explosive loading truck, provided with a GPS (Global Positioning System), which enables the truck to automatically fill the holes comprised in a bench, as required for filling of each of these holes.

In the truck, information such as the geographic positioning of the holes (latitude and longitude), depth and diameter of each hole, and the level of water found in each hole is stored. This information is compared to real data, measured by technicians and engineers who surround the rock bank before completing the hole filling step. This data is sent to the devices in the truck through a wireless communication path.

The major problem with the technology of WO2010144952 is the fact that the truck shown in this document requires human intervention at various stages of the operation, for example, while inserting the detonator into the hole and during the data input into the truck.

WO2014063188 shows a truck for loading bench holes in open-pit exploration mines. The truck has a GPS positioning system and comprises a sensor configured for real-time measurement of the internal properties of a hole. The sensor comprised by the WO2014063188 technique is preferably located at the tip of the explosive delivery tube, in such a position as to enable it to have visual access to the bottom of the hole.

The main problem of WO2014063188 is that it does not contain an automatic manipulating means which is capable of reproducing all the activities performed by the operator in charge of the deposition of explosives.

Thus, it is concluded that both the manual technique of deposition of explosives and the semi-automatic techniques shown in the state of the art are unable to provide a method or equipment for deposition of explosives that can reproduce all activities performed by the manual operator in the deposition of explosives and is absolutely free from any human intervention.

SUMMARY OF THE INVENTION

The invention relates to a vehicle configured for the deposition of explosives in holes of open-pit mines, the vehicle configured to perform all seven steps carried out in the manual explosive deposition process, automatically, completely free of human intervention.

This invention also aims at a method of use of the aforementioned vehicle.

BRIEF DESCRIPTION OF DRAWINGS

This invention is described in detail, based on the respective figures.

DETAILED DESCRIPTION OF INVENTION

Figure 1:
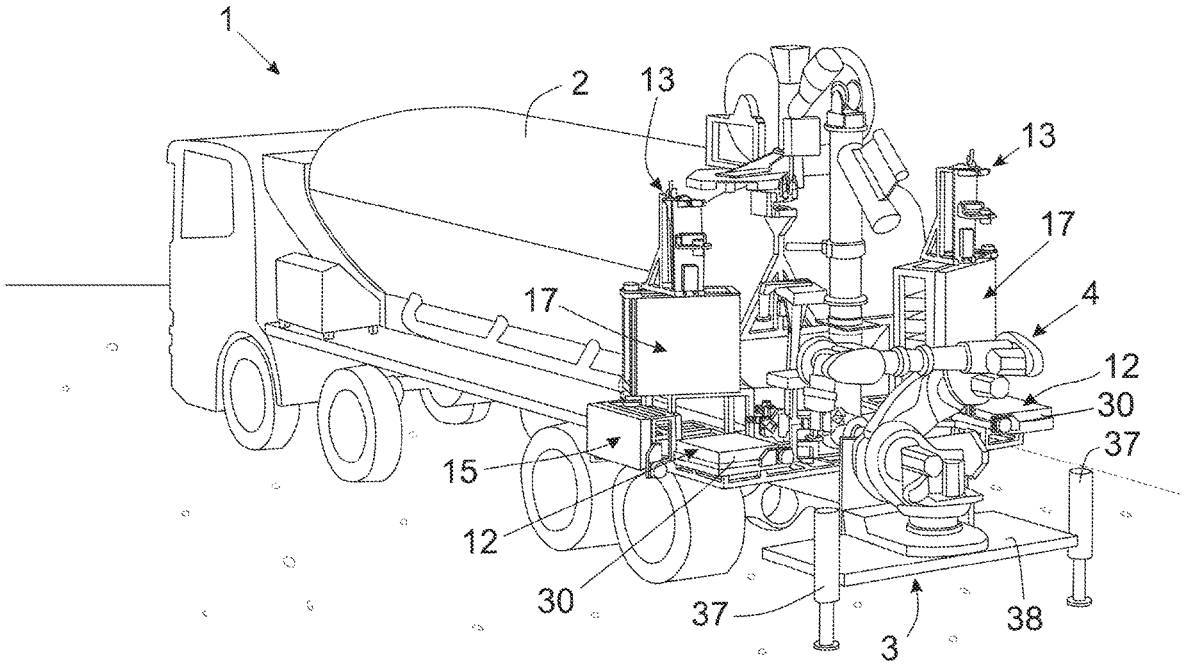
FIG. 1—top perspective view of the vehicle of this invention.
Figure 2:
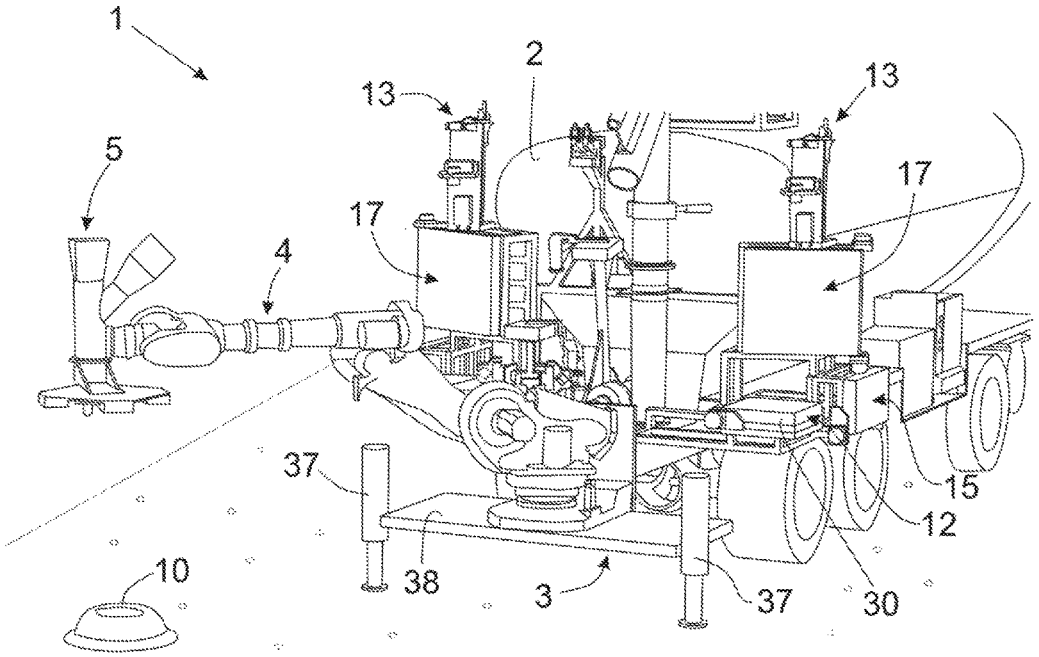
FIG. 2—back perspective view of the vehicle of this invention.

As disclosed in FIGS. 1 and 2, this invention consists of a vehicle 1 configured for complete automation of the explosive deposition operation preceding the blasting of benches 39 in an open-pit mine.

The truck shown in FIGS. 1 and 2, hereinafter referred to as vehicle 1, is provided with at least one GPS device, a high precision geo-positioning system, an electronic processor for autonomous orientation of the vehicle, and a propulsion system. These devices allow the vehicle 1 to travel independently, i.e., without any human intervention on the upper surface of a mine bench 39.

With the GPS device (not shown in the figures), the said geo-positioning system, and geolocation (geographic coordinates) of the holes 10, the vehicle 1 is able to direct itself to each of the holes 10 of the mine to be explored. It should be noted that autonomously driven vehicles are not novel in the state of the art, as exemplified by U.S. Pat. Nos. 6,272,405, 6,996,462 and DE102009010006. Based on these prior state of the art, a person skilled in the art provided with a GPS device, a high precision geo-positioning system and an electronic processor is able to program the vehicle 1 for autonomous movement on a bench 39.

Upon reaching a given hole 10, the vehicle 1 is positioned so that the free end of its robotic arm 4 is within reach of the hole 10. Then, the explosive deposition procedure is initiated.

The information required by vehicle 1 is the rock blasting plan data and the geographic coordinates of the holes 10. Based on these data, the vehicle 1 is able to estimate the amount of explosives in each hole 10 and the necessary primer accessories to each of them.

Upon approaching the hole 10, the vehicle 1 can recalculate the amount of explosives and the primer accessories for each hole 10, based on changes in the depth of the hole 10 (due to accidental collapse of soil), by the presence of water, or by the evidence of cracks and the presence of brittle material inside the hole 10. If there is water inside the hole 10, the vehicle 1 automatically determines the replacement of ANFO by an emulsion (non-water soluble explosive). If there is hard material inside the hole, vehicle 1 determines the insertion of a high density explosive.

All changes detected in holes 10 along with the decisions made by the vehicle 1 to bypass those changes are recorded in an electronic memory or made available in real time for remote monitoring.

The vehicle 1 comprises an explosive storage tank 2, a vertical translation platform 3, and a robotic arm 4.

In its preferred configuration, vehicle 1 also comprises: three claws engageable to the free end of the robotic arm 4, each of which is endowed with a specific function and purpose. They are: first claw 5, second claw 7 and third claw 19.

The first claw 5 is configured for manipulation of the ANFO and emulsion hoses, for orientation of a probe, and for housing of the vision system 36.

The second claw 7 is configured to manipulate the boosters 11, the shock tubes 18, the fuses 16, and the weights 14.

The third claw 19 is configured to buffer the hole 10 at the end of the explosive deposition process.

Preferably, the vehicle 1 also comprises: a booster magazine 12; a weight magazine 15; a fuse and shock tube magazine 17; and a mounting device 13. The three magazines 12, 15, 17 have the function of storing boosters 11, weights 14 and shock tubes 17, that is, the elements necessary for making the detonator 8. The fourth element, the mounting device 13, has the function of assisting in the process of mounting the said detonator 8.

According to the Brazilian Army's Regulations for Inspection of Controlled Products (R-105), explosive materials and explosive primers cannot be transported together, therefore, the detonator 8 must be mounted at the moment of application in the hole 10.

The explosives storage tank 2 is preferably provided with at least two insulated compartments: one for ANFO (for deposition in dry holes 10) and one for emulsions (for deposition in holes 10 with water). Alternatively, tank 2 may comprise a third internal compartment, configured for storing a high density explosive for detonation of hard rocks.

The vertical translation platform 3 has the function of leveling the robotic arm 4 relative to the ground (this is necessary since the upper surface of the mine benches 39 is usually quite bumpy), and to arrange the robotic arm 4 at an ideal work height. To accomplish this function, the vertical translation platform 3 comprises at least two (hydraulic or pneumatic) pistons 37 arranged under a metal plate 38 (see FIGS. 1 and 2).

An operational flow chart of the vehicle 1 is shown below:

Step 1—the vehicle 1 parks near the hole 10.

Step 2—The robotic arm 4 engages the first claw 5 and performs a mapping of the hole 10 with the vision system 36 comprised by claw 5. This mapping is mainly performed to determine the precise location of the center of the hole 10.

Step 3—the robotic arm 4 checks the depth and presence of water inside the hole 10 by inserting a probe therein.

Step 4—deposit a first portion of explosive (until it fills approximately 1 meter of the column from the hole bottom).

Step 5—the robotic arm 4 disengages the first claw 5 and engages the second claw 7, configured to handle the detonator 8.

Step 6—robotic arm 4 mounts the detonator 8 (booster assembly 11+fuses 16+shock tubes 18+weight 14).

Figure 7:
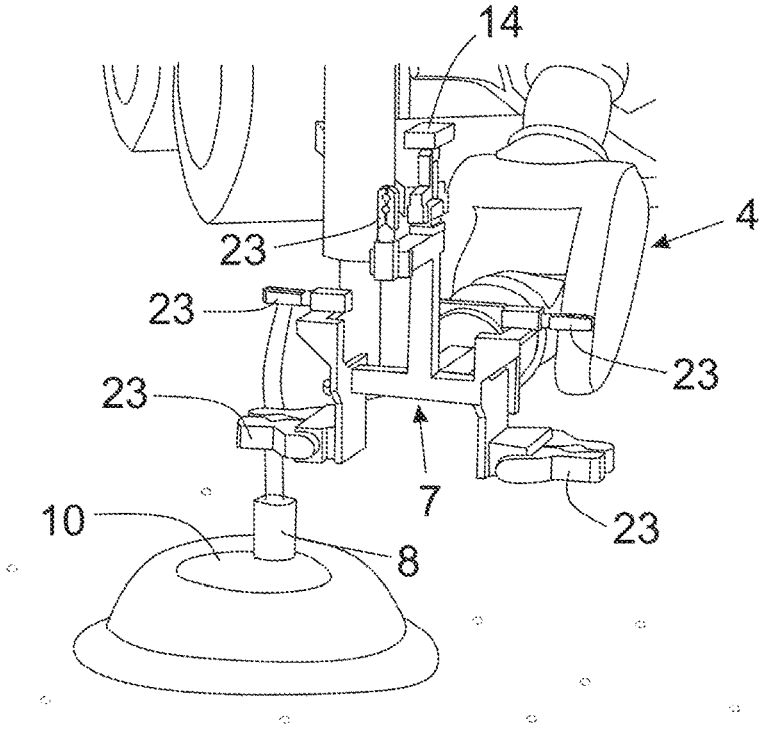
FIG. 7—front view of the second claw lowering the booster into the blast hole.

Step 7—the robotic arm 4 inserts the detonator 8 into the hole 10 at a constant speed (see FIG. 7).

Figure 8:
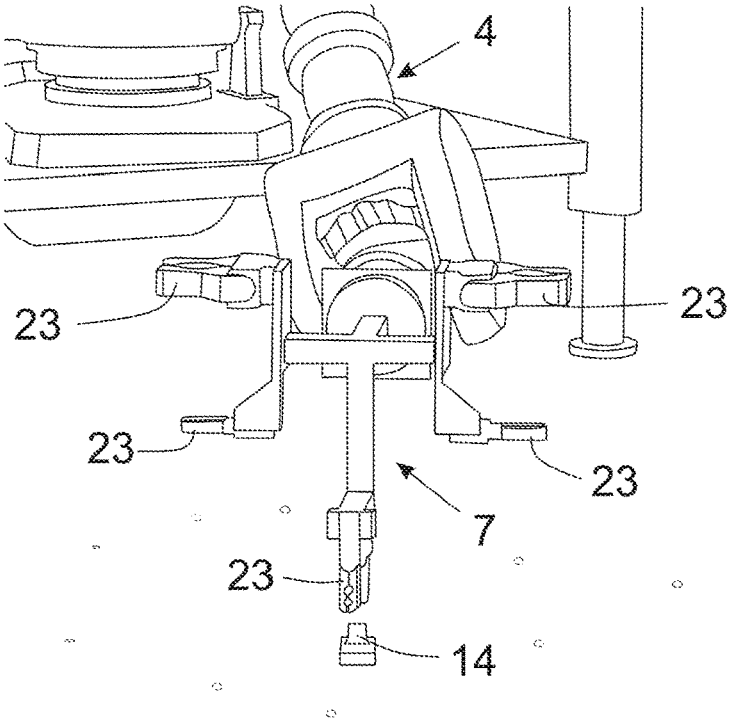
FIG. 8—front view of the second claw releasing the anchoring weight of the shock tube, beside the blast hole.
Figure 9:
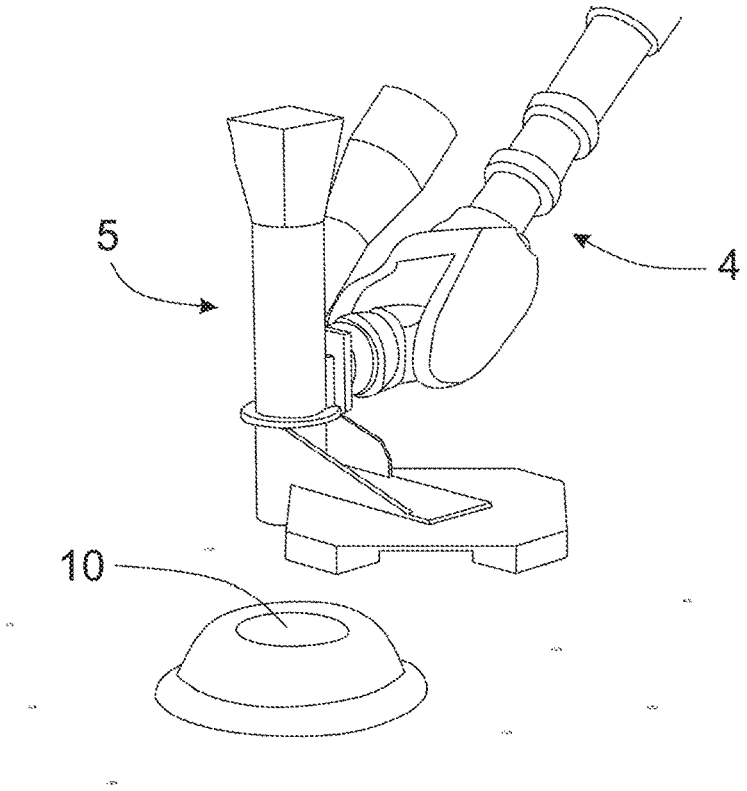
FIG. 9—front view of the first claw associated with the free end of the robotic arm of the invention.

Step 8—the robotic arm 4 releases the weight 14 on the ground, next to the edge of the hole 10, to anchor the free end of the shock tube 18 at a location far from the hole 10 opening 10 (see FIG. 8).

Step 9—the robotic arm 4 changes the second claw 7 for the first claw 5.

Step 10—complementation of the explosive deposit in the hole 10.

Step 11—the robotic arm 4 changes the first claw 5 for the third claw 19.

Figure 10:
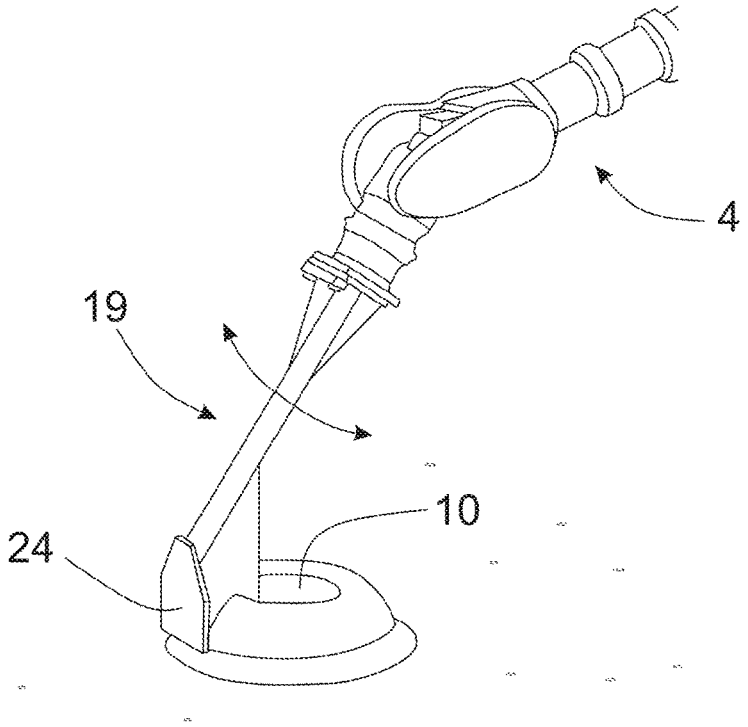
FIG. 10—perspective view of the third claw performing the buffering process of the blast hole.
Figure 11:
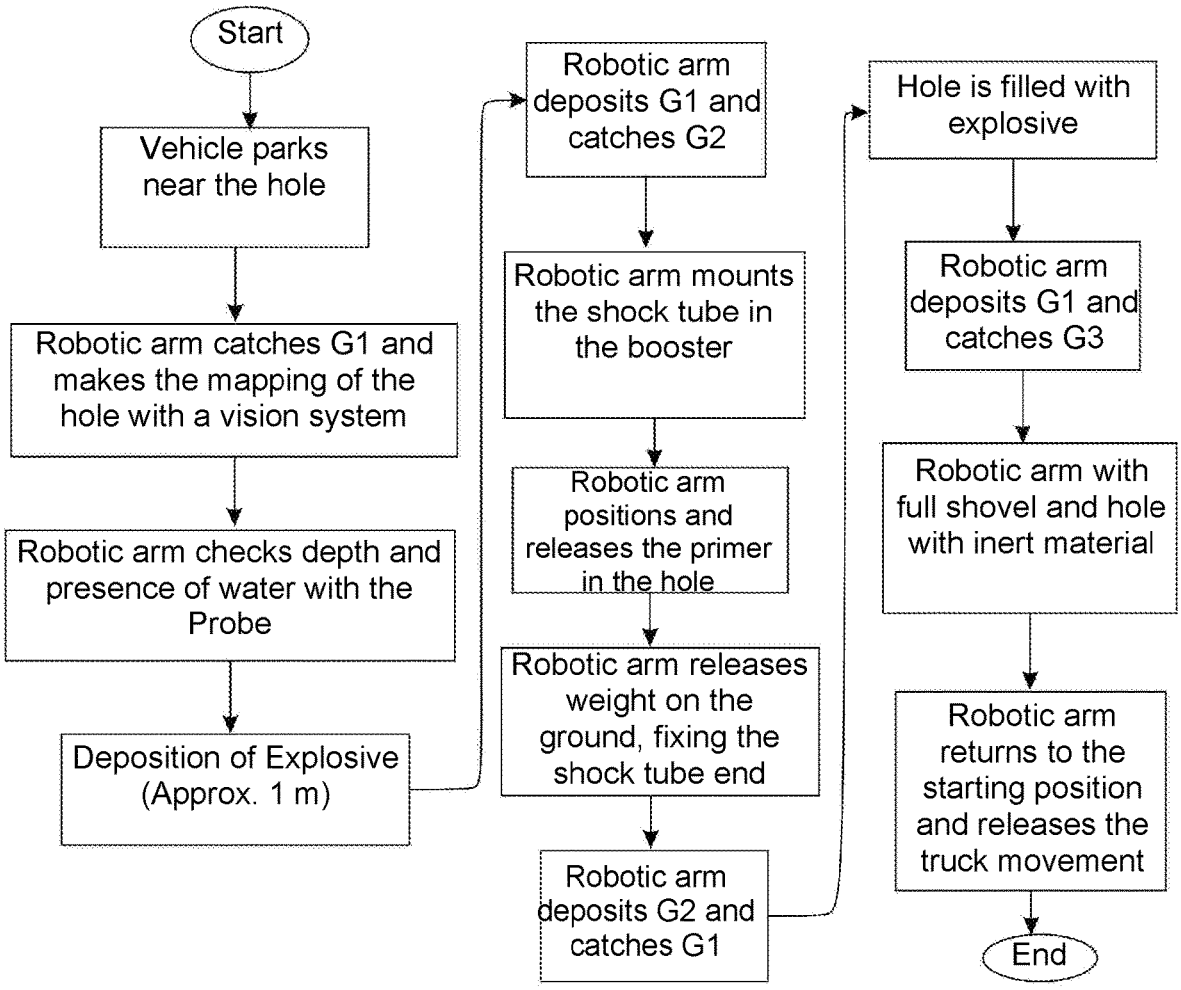
FIG. 11—operational flow chart of the method of this invention.

Step 12—the robotic arm 4 performs the buffering (insertion of earth in the upper portion of the hole) with the aid of the third claw 19 (see FIG. 10).

Step 13—the robotic arm 4 returns to the starting position and releases the vehicle 1 movement.

Figure 5:
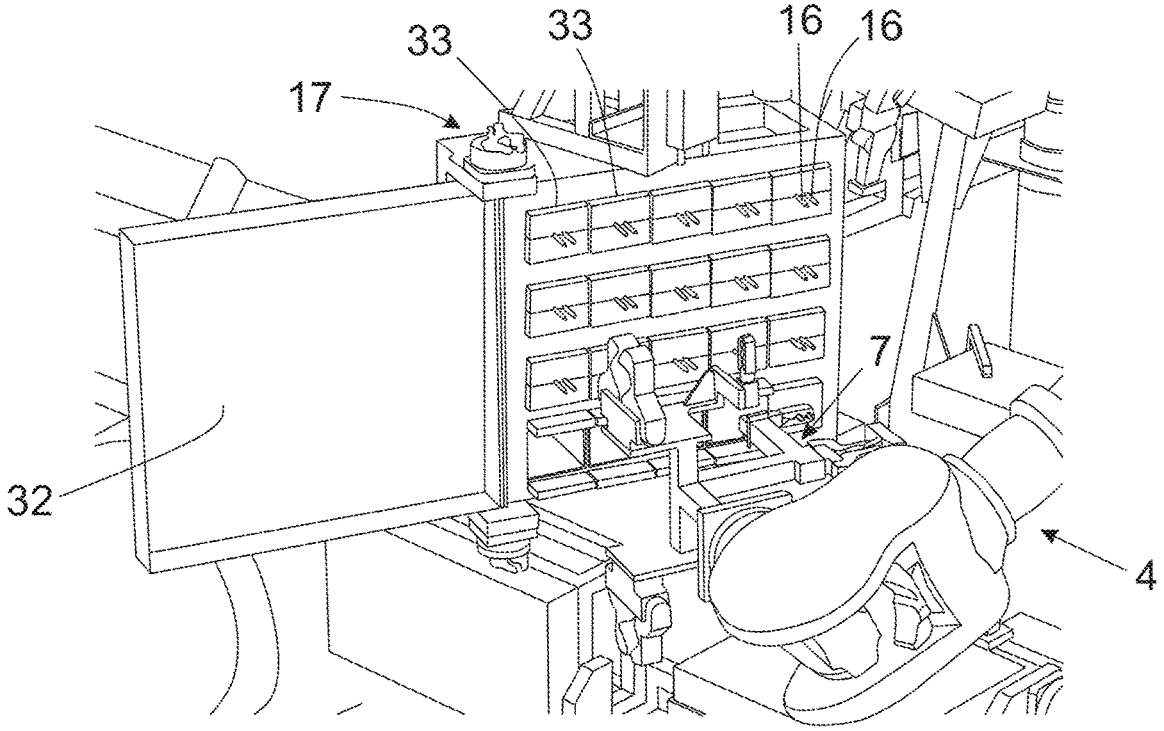
FIG. 5—top perspective view of the robotic arm attached to the second claw, in front of the magazine of fuses and shock tubes of the vehicle of invention.
Figure 6:
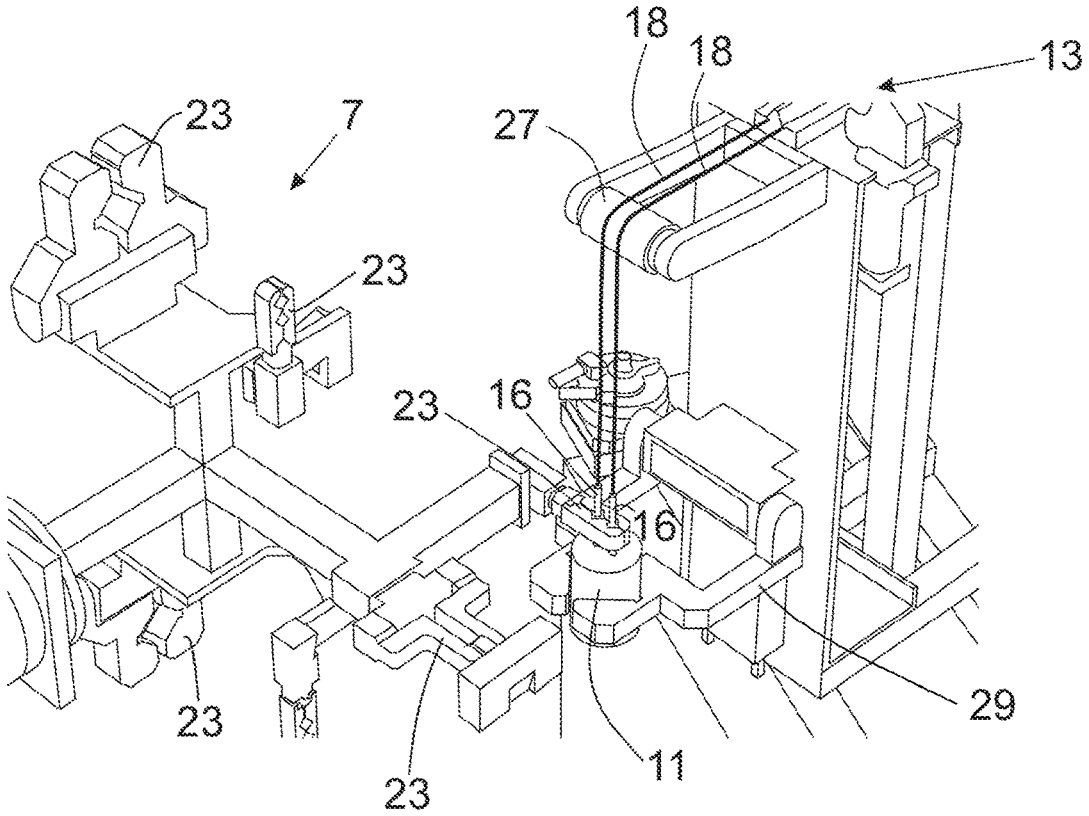
FIG. 6—top perspective view of the second claw performing the insertion process of fuses into the booster.

The step 6 defined above, the detonator 8 assembling can be subdivided into six distinct sub-steps, namely: step 6A: removing the booster 11 from its magazine 12 and transporting it to the mounting device 13 (see FIG. 3); step 6B—removing the weight 14 from the weight magazine 15 (see FIG. 4); step 6C—removing a pair of fuses 16 from the fuse and shock tube magazine 17 and raising these elements to facilitate the unwinding of the shock tubes 18 (see FIG. 5); step 6D—passing the shock tubes 18 through the mounting device 13 to enable subsequent introduction of the fuses 16 through the booster 11 holes; step 6E—raising the linear cylinder 28 so that the fuses 16 are available in the lower part of the booster 11 (see FIG. 6); and step 6F—the robotic arm 4 rotates the fuses 16 in order to execute a loop and allow its reinsertion into the booster 11.

After inserting the detonator 8 assembled by means of the steps mentioned above, a weight 14 is positioned on the shock tube 18 on the open-pit mine surface, this being step 8.

Some features of each of the claws 5, 7 and 19 and of the mounting device 13 comprised by the vehicle 1 are shown below.

First Claw 5

It is the claw configured for manipulation of the ANFO and emulsion hoses, for manipulation of a probe and the vision system 36.

Figure 12:
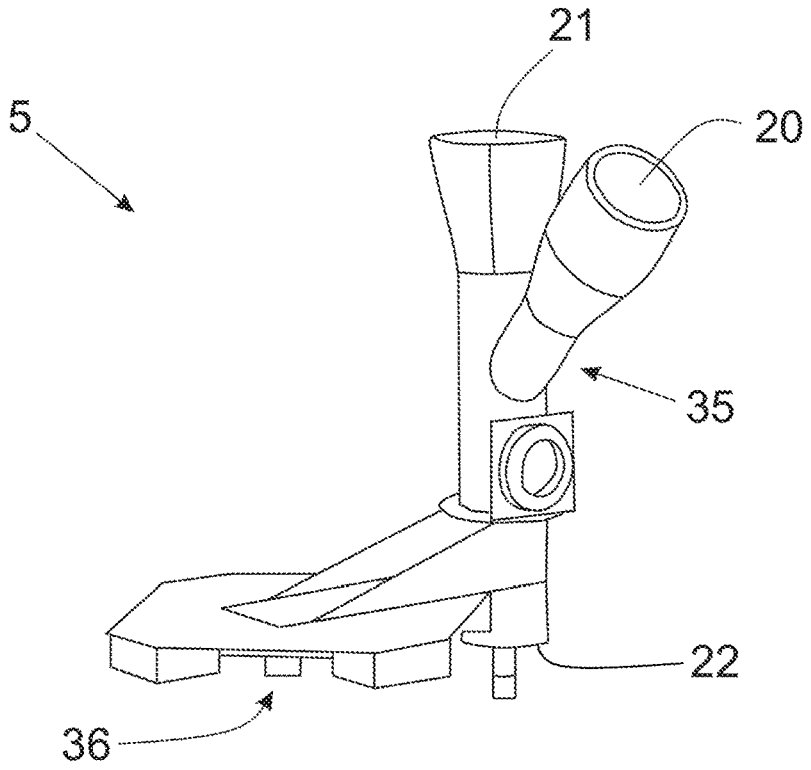
FIG. 12—side view of the first claw of this invention.

The first jaw has Y-shaped junction 35 in order to concentrate the two explosive inlets into a single outlet. Note that the ANFO 20 inlet and the inlet of the emulsion hose 21 converge to a single outlet 22 located at the distal end of the first claw 5 (see FIG. 12).

For the deposition of the explosive mass, a hose comprised within the first claw 5 descends to the bottom of the hole 10, and it is only when its free end approaches the bottom of the hole 10 that the emulsion deposition begins, preventing the loss of efficiency of the explosive mass in the detonation due to contamination with rock dust expelled and accumulated in the hole 10 collar during the drilling.

The vision system 36, also in the claw 5, is configured to accurately determine the center of the hole 10 so that the claw 5 is able to work dexterously on the hole 10.

The vision system 36 is comprised of a device for performing a sort of scanning of the hole 10 collar by means of laser sensors, allowing the precise definition of the center of the hole 10 on the surface.

The first claw 5 also comprises a probe. Said probe is provided with at least one sensor and a holding cable (not shown in the figures). Before starting the deposition of explosives in the hole 10, the probe is introduced into the hole 10 to calculate the actual depth thereof and to identify the presence of water within the hole 10. Alternatively, the probe may also identify other features of the hole 10, such as: the presence of brittle or hard material; the presence of pockets (empty spaces around the hole); and the understanding of cracks in the inner wall of the hole 10.

The probe will be provided with at least one encoder installed in the sensor cable windings to check for the actual depth of the hole 10; and a sensor for detecting liquids to check for the presence of water. Alternatively, the probe may be comprised of ultrasonic, laser, or Gamma-GT sensors for analyzes of lithological profile, cracks and/or pockets (empty areas).

Second Claw 7

The second claw 7 is used to assist in the mounting of the detonator 8.

Figure 3:
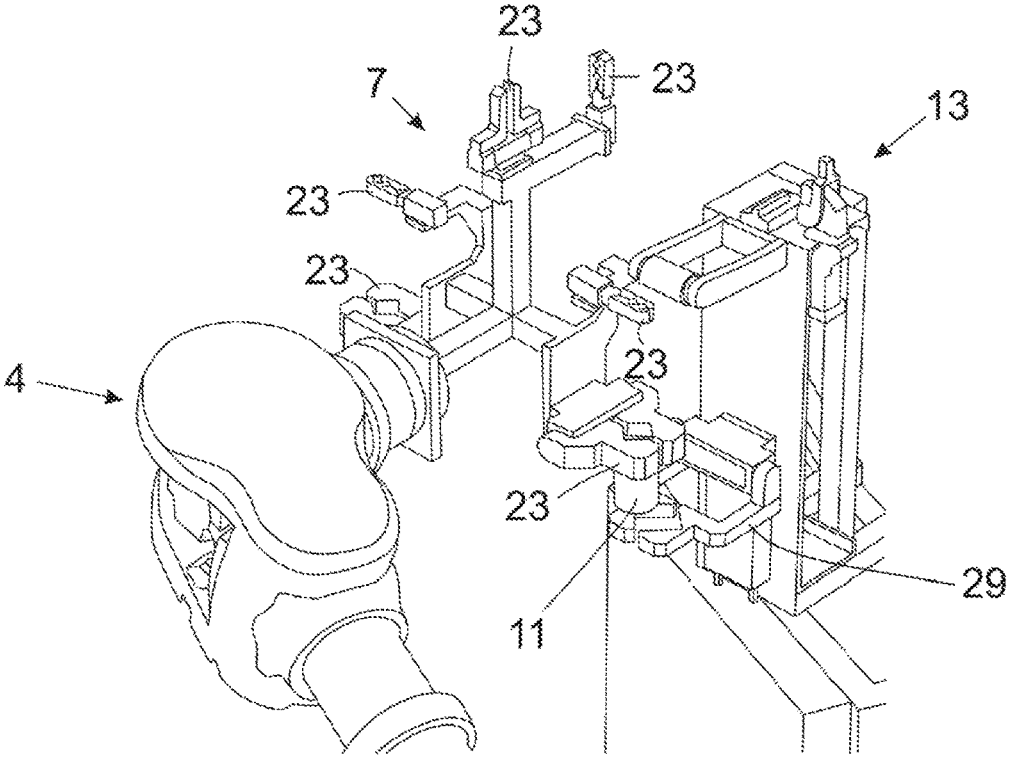
FIG. 3—top view of the free end of the robotic arm attached to the second claw, near the mounting device.
Figure 13:
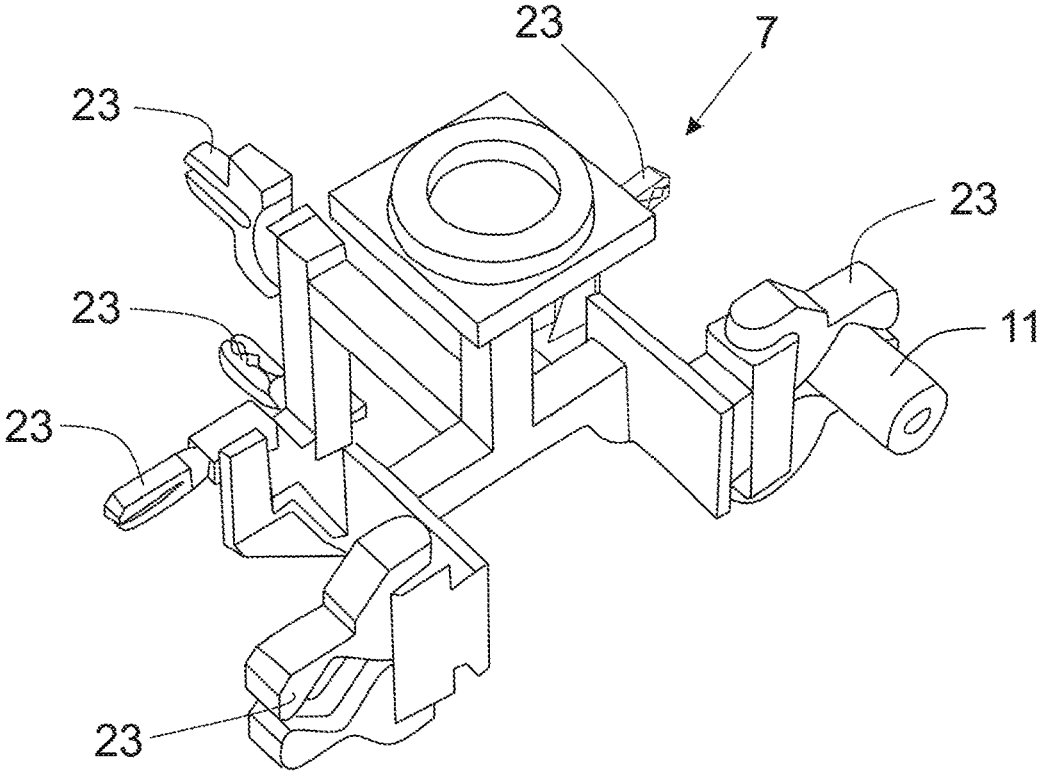
FIG. 13—top perspective view of the second claw.

Preferably, the second claw 7 comprises four types of grippers 23, as shown in FIGS. 3, 8 and 13. Each of these gripper models 23 is used for the manipulation of a given object (weights 14, fuses 16, shock tubes 18, and boosters 11).

The second claw 7 shows a symmetrical structure which repeats two gripper models 23 on either side of the second claw 7, allowing the access of the robotic arm 4 on both sides of the vehicle 1 (in FIGS. 7 and 8, it can be clearly seen the defined symmetry of the second claw 7).

Third Claw 19

The main function of the third claw 19 is the manipulation of the amount of earth present around the hole 10.

Figure 14:
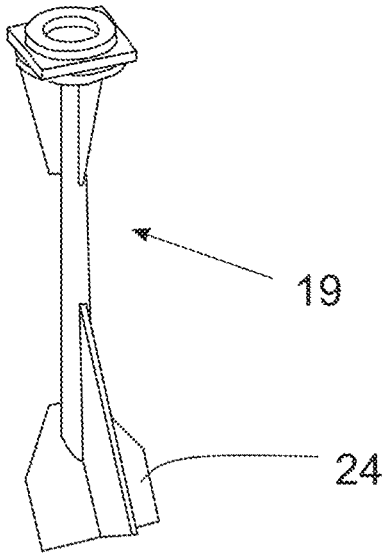
FIG. 14—front view of the third claw.

The third claw 19 comprises a shovel-shaped end 24, which function is to allow the manipulation of earth during the process of buffering the hole 10 (see FIGS. 10 and 14).

Mounting Device 13

The mounting device 13 is used to help the robotic arm in the manipulation of elements comprised by the detonator 8 (weights 14, fuses 16, shock tubes 18, and boosters 11).

Figure 15:
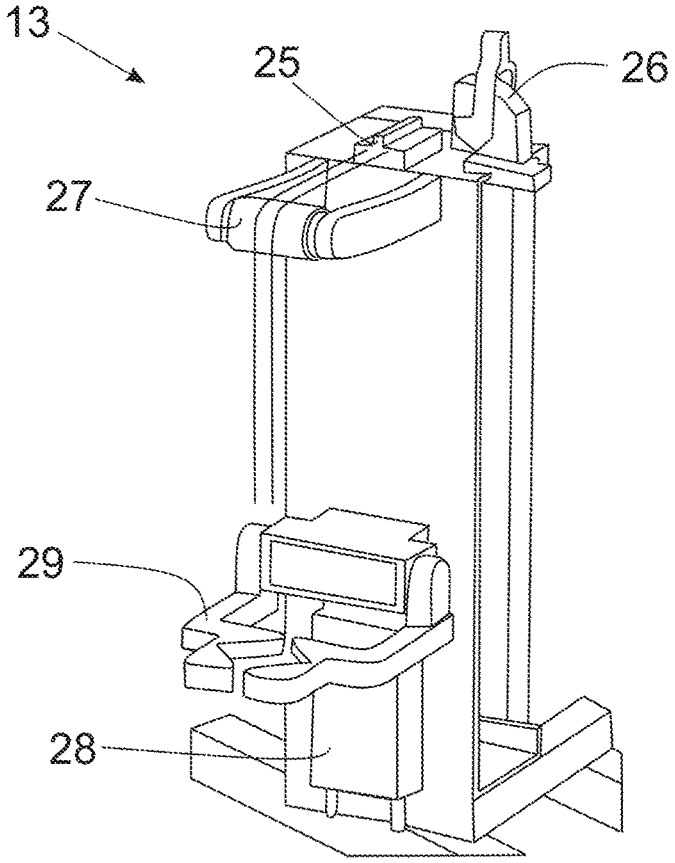
FIG. 15—front view of the mounting device.
Figure 16:
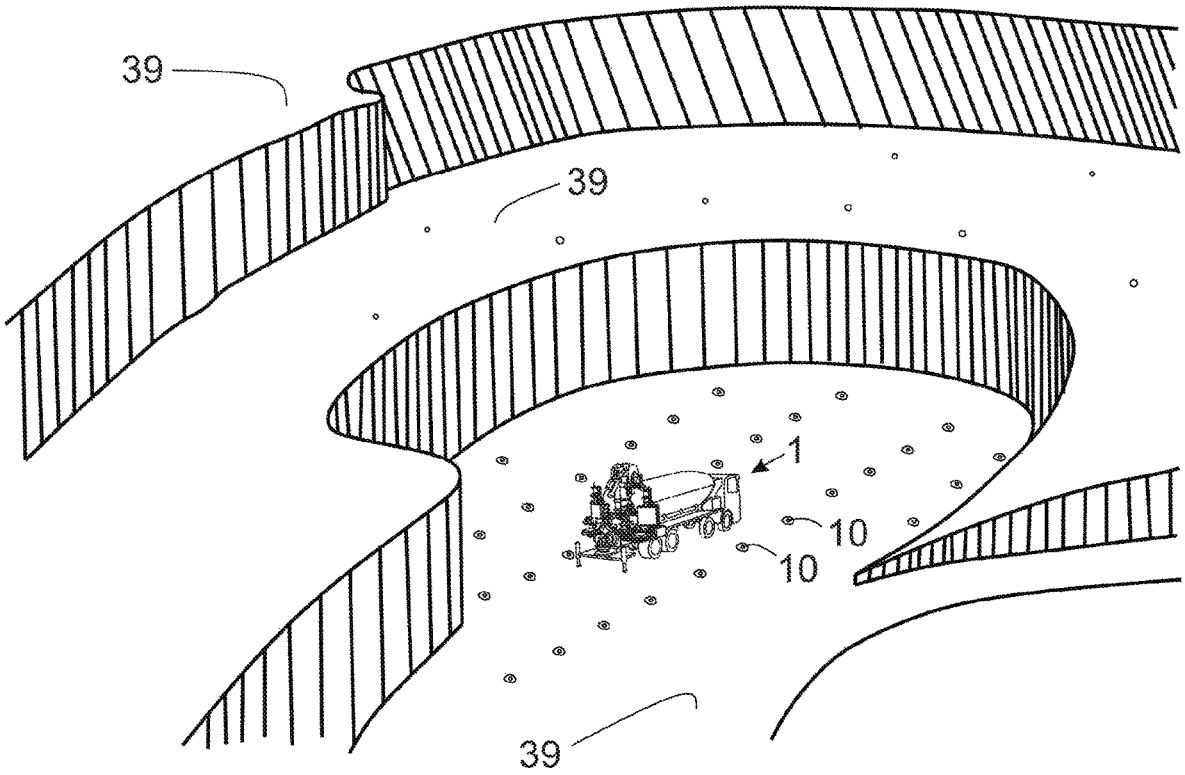
FIG. 16—top perspective view of the vehicle of this invention moving on a bench of an open-pit exploration mine.

The mounting device 13 comprises: a pipe separator 25; a pipe brake clamp 26; an alignment roller 27; a linear cylinder 28; and a booster holder 29, arranged as shown in FIG. 15.

The mounting device 13 is fed by the robotic arm 4 using the second claw 7 for mounting the detonator 8, as described in step 6. The booster holder 29 keeps the booster 11 with the orifices aligned; the pipe separator 25 and the alignment roller 27 ensure the clamping, tensioning and parallelism of the shock tubes 18. After the second claw 7 has inserted the fuses 16 into the upper holes of the booster 11 (steps 6D and 6E), it releases the fuses 16 and the linear cylinder 28 performs vertical movement, exposing again the pair of fuses 16 in the lower part of the booster 11, allowing the second claw 7 to handle again the pair of wires 16 to allocate them in opposing holes, concluding the mounting of the detonator 8. The pipe brake clamp 26 keeps the shock tube 18 locked, and it is released during insertion of the detonator 8 into the hole 10 in step 7.

Some features of each of the magazines 12, 15 and 17 comprised by the vehicle 1 are shown below.

Booster Magazine 12

Preferably, the booster magazine 12 comprises a pneumatic cap 30, a mask which prevents the chattering and contact between the boosters 12, and locators with fixed positions in the magazine to ensure correct supply by the operators (the booster magazine 12 is shown with the cap 30 closed in FIGS. 1 and 2 of this report).

Among other types of boosters 11, the booster magazine 12 is capable of holding boosters with 900, 450 or 250 grams.

Fuse and Shock Tube Magazine 17

The main function of the fuse and shock tube magazine 17 is to provide pairs of fuses 16 and shock tubes 18 to the robotic arm 4 and to enable the safe transport of these elements.

The fuse and shock tube magazine 17 comprises a pneumatic cap 32 configured to insulate the fuses 16 from the external environment, and a set of rams 33, each having two shock tubes 18 and their respective fuses 16.

Each ram 33 comprises a pair of spring hinged hatches, provided with grooves for positioning the fuses 16. This system facilitates the delivery of the fuses 16 to the robotic arm 4.

Among other fuses 16, this magazine is compatible with Exel-type fuses 16.

Weight Magazine 15

The weight magazine 15 has the function of making the weights 14 available to the robotic arm 4, and allowing a safe transport of these elements.

Figure 4:
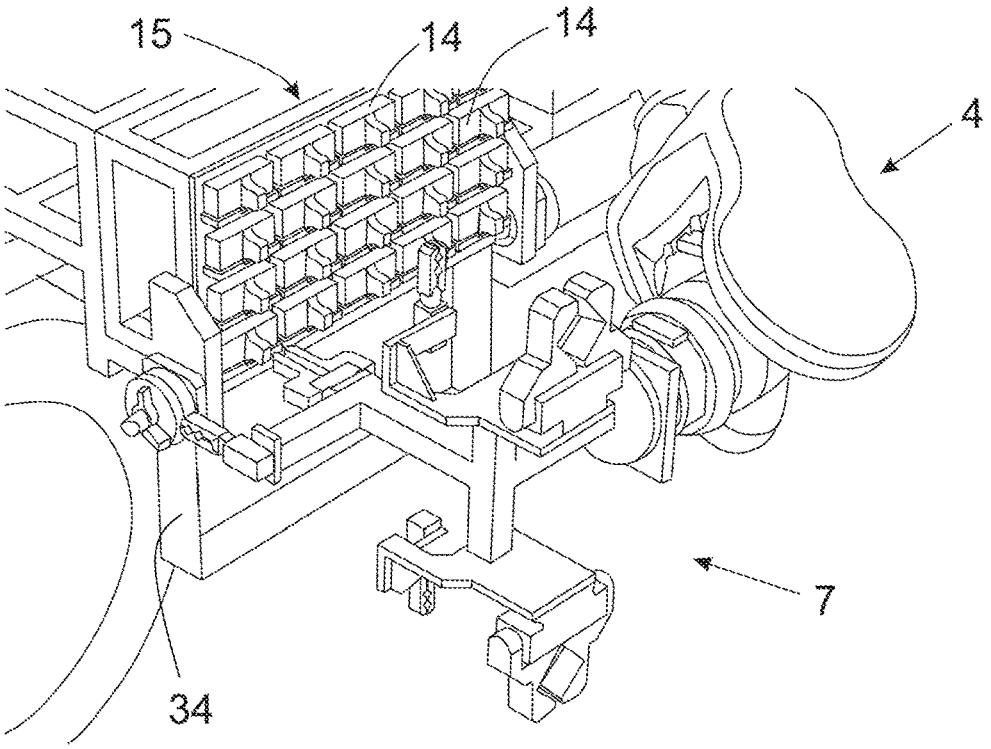
FIG. 4—top perspective view of the robotic arm attached to the second claw, in front of the magazine of weights of the vehicle of invention.

Preferably, the weight magazine 15 comprises a pneumatic cap 34 and locators, configured to ensure the position and correct supply by the operators (see FIG. 4).

Having described some examples of preferred achievement of the invention, it is noteworthy that the scope of protection given by this document encompasses all other alternative forms appropriate to the execution of the invention, which is defined and limited only by the content of the claim scope attached.

The invention claimed is:

1. A vehicle for deposition of explosives in blast holes, comprising:

an explosive storage tank;

a vertical translation platform; and a robotic arm;

the explosive storage tank comprising at least one airtight container capable of holding explosive in liquid or granular form therein;

the vertical translation platform being configured to position the robotic arm, and level the robotic arm to offset ground unevenness;

the robotic arm comprising at least two movement axes, a gripper, a sensor, and at least three claws at a free end of robotic arm, each of the at least three claws with a different function, the robotic arm configured to:

analyze inside of a hole, and guide the sensor near to an upper edge of the hole, using one of the at least three claws;

guide a first discharge of explosive;

assemble a detonator;

deposit the assembled detonator into the hole;

guide a second discharge of explosive into the hole; and buffer the hole after guiding the first discharge of explosive and the second discharge of explosive into the hole;

the vehicle further comprising: a GPS device, a propulsion system, and an electronic processor, configured to guide the vehicle independently.

2. The vehicle for deposition of explosives in blast holes according to claim 1, wherein the robotic arm comprises four movement axes.

3. The vehicle for deposition of explosives in blast holes according to claim 1, wherein a first claw is configured for manipulation of ANFO and emulsion hoses.

4. The vehicle for deposition of explosives in blast holes according to claim 3, wherein the first claw is configured for measurement of hole depth and for detection of water inside the hole.

5. The vehicle for deposition of explosives in blast holes according to claim 3, wherein the first claw comprises a vision system configured to locate a center of the hole.

6. The vehicle for deposition of explosives in blast holes according to claim 1, further comprising a second claw configured for assembling of detonators through handling of boosters, shock tubes, fuses and weights.

7. The vehicle for deposition of explosives in blast holes according to claim 6, wherein the second claw comprises at least four different types of grippers, each one configured to manipulate specifically one of the boosters, the shock tubes, the fuses and the weights comprised by the detonator.

8. The vehicle for deposition of explosives in blast holes according to claim 1, further comprising a third claw configured to buffer the hole at an end of an explosive deposit process, the third claw fitted with an end configured as a shovel.

9. The vehicle for deposition of explosives in blast holes according to claim 1, wherein the vertical translation platform comprises a metal plate and two pistons, wherein the two pistons are perpendicular to a metal plate structure.

10. The vehicle for deposition of explosives in blast holes according to claim 1, further comprising a mounting device configured to help mount the detonator.

11. The vehicle for deposition of explosives in blast holes according to claim 10, wherein the mounting device comprises: a pipe separator; a pipe brake clamp; an alignment roller; a linear cylinder; and a booster holder.

12. The vehicle for deposition of explosives in blast holes according to claim 1, further comprising three magazines for safe storage of boosters, shock tubes, fuses and weights to prepare the detonator.

13. The vehicle for deposition of explosives in blast holes according to claim 1, wherein the explosive storage tank is fitted with two different containers: a container for ANFO storage, and a container for emulsion storage.

14. The vehicle for deposition of explosives in blast holes according to claim 1, wherein the explosive storage tank is fitted with three different containers: a container for ANFO storage, a container for emulsion storage, and a container for high density explosive storage.

15. The vehicle for deposition of explosives in blast holes according to claim 1, wherein the vehicle is fully independent from human intervention, once it is laid out on an upper surface of a mine bench before a blasting operation.

16. A method of using the vehicle according to claim 1 for depositing explosives in a blast hole, comprising:

parking the vehicle near the blast hole;

engaging the robotic arm and a first claw and mapping the hole with a vision system;

checking a hole depth and presence of water inside it by inserting a probe into the hole;

depositing a first portion of explosive into the hole;

disengaging the robotic arm from the first claw and engaging a second claw, the second claw configured to handle the detonator;

mounting the detonator;

inserting the detonator into the hole at a constant speed;

releasing a weight onto ground, next to an edge of the hole;

changing the second claw for the first claw;

depositing the explosive in the hole;

changing the first claw for a third claw;

buffering the hole with the third claw;

returning the robotic arm to its starting position and releasing the vehicle towards another hole.

17. The method according to claim 16, wherein the mounting of the detonator further comprises:

removing a booster from a booster magazine, and transporting the booster to the mounting device;

removing the weight from a weight magazine;

removing a pair of fuses from a fuse and shock tube magazine and raising these elements to facilitate unwinding of shock tubes;

passing the shock tubes through the mounting device;

raising a linear cylinder so that the pair of fuses are available in a lower part of the booster; and performing a rotation of fuses in order to execute a loop and allow reinsertion into the booster.

* * * * *